United States Patent [19]

Cvacho

[11] Patent Number: 4,513,595

[45] Date of Patent: Apr. 30, 1985

[54] METHODS OF NECKING-IN AND FLANGING TUBULAR CAN BODIES

[76] Inventor: Daniel S. Cvacho, 241 Kirkley Cir., Forest, Va. 24551

[21] Appl. No.: 559,809

[22] Filed: Dec. 9, 1983

Related U.S. Application Data

[62] Division of Ser. No. 346,586, Feb. 8, 1982, Pat. No. 4,446,714.

[51] Int. Cl.[3] ..... B21B 45/02

[52] U.S. Cl. ..... 72/43; 413/1; 413/69

[58] Field of Search ..... 72/43, 44, 348, 349; 184/18, 102; 413/1, 69

[56] References Cited

U.S. PATENT DOCUMENTS 3,983,729 10/1976 Traczyk ..... 72/43

FOREIGN PATENT DOCUMENTS 625011 6/1949 United Kingdom ..... 72/349

*Primary Examiner*—Leon Gilden

*Attorney, Agent, or Firm*—Richard P. Matthews

[57] ABSTRACT

Methods of necking-in and flanging tubular can bodies having body walls of constant thickness. A pilot die initially inserted into the tubular can body reverses its direction during the necking-in operation with respect to the motion of a ring die member that contacts the exterior surface of the tubular can body member. This concurrent reverse movement of the two forming dies eliminates wrinkles in the necked-in region and produces a container body with increased columnar strength. Repetitive use of the method produces containers with two or three necked-in portions. A method is also disclosed for relubricating the necked-in area of the tubular can body between the successive necking stations.

5 Claims, 20 Drawing Figures

METHODS OF NECKING-IN AND FLANGING TUBULAR CAN BODIES

This is a division of U.S. patent application Ser. No. 346,586, filed Feb. 8, 1982 now U.S. Pat. No. 4,446,714.

This invention relates to methods of necking-in and flanging tubular members such as can body members and, in particular, to the necking-in and flanging such members which have body walls of constant thickness.

BACKGROUND OF THE INVENTION

Heretofore it has been known to neck in tubular bodies such as can ends and then outwardly flange the end of the body so as to receive a can end thereon of smaller diameter than a body wall which has not been necked-in. A major problem has existed in the known prior art techniques, namely, wrinkling of the neck of the container. Thus, existing can body manufacturing typically requires a thickened neck structure for the can so that it will not wrinkle in forming the end. Previous minimum wall thickness in the region of the can to be necked-in was about 0.007–0.0075 inches. With the present invention and method of forming, a uniform thickness for the region to be necked-in and the remainder of the body wall of the container of 0.005 inches is possible without wrinkling.

Another problem of the prior art which was inherent because of the first problem was how to obtain a plurality of closely-spaced successively necked-in portions for a container body wall on an economical basis. With the increased thicknesses required in the prior art techniques at the location of the necked-in area, the costs were prohibitive and/or the wrinkling excessive.

SUMMARY OF THE INVENTION

In accordance with the present invention the foregoing shortcomings and limitations of the known prior art methods of manufacture are effectively overcome in the practice of the present invention. In particular, the methods of the present invention include the insertion of a pilot die into a cylindrical tubular member to be necked and the contacting of the exterior surface of the tubular member with a ring necking die. As the actual necking-in occurs, the direction of movement of the pilot die is reversed so that the pilot die and the ring necking die are concurrently moving in opposite directions. The pilot die not only provides an anvil or back up for the ring necking die but also functions to smooth out the necked-in area of the tubular member. With this method repetitive or successive necked-in end portions of container body wall may be formed. Moreover, they may all be formed from a necked-in thickness equal to the remainder of the body wall in the order of magnitude of 0.005 inches.

Another feature of the present invention is the process of relubricating the necked-in areas of the container body wall on a continuous in-line basis after the initial necking-in operation. In particular, the can body to be relubricated following at least one necking-in operation is transferred to an intermediate work station, such as a star wheel. An oil containing member that receives oil at its surface by capillary action is positioned in the path of movement of the can body. As the can body contacts the oil containing member it begins to rotate. The oil containing member is made sufficiently long so that the entire circumference of the can body is contacted and thereby oiled. The can body is then returned in-line for a subsequent necking-in operation or flanging operation.

The inherent advantages and improvements of the present invention will become more readily apparent by reference to the following detailed description of the invention and by reference to the following drawings.

Figure 11A:
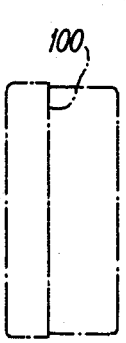
Figure 11:
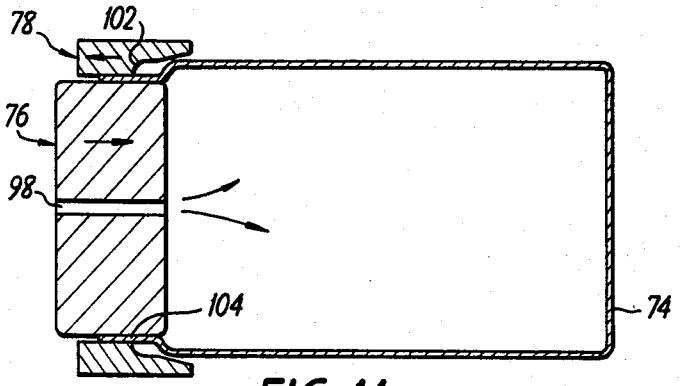
Figure 13:
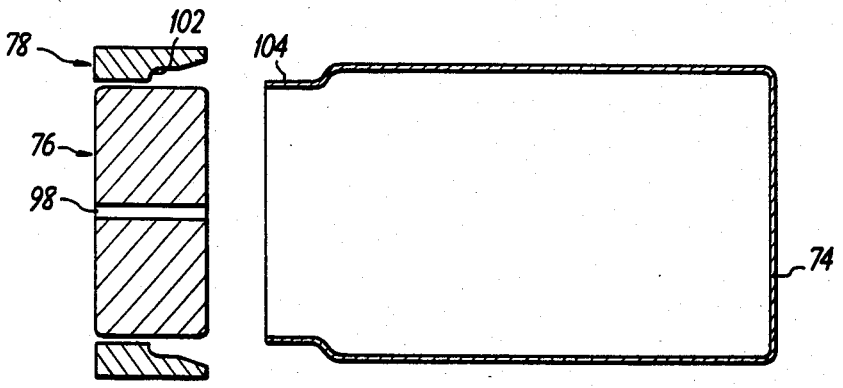
Figure 14:
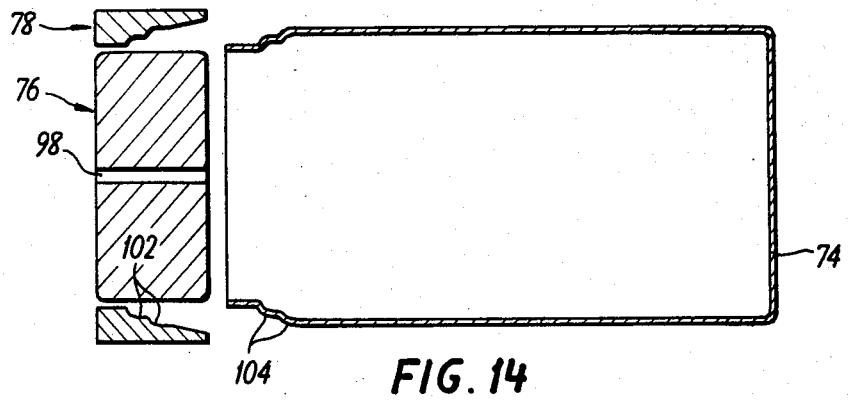
Figure 15:
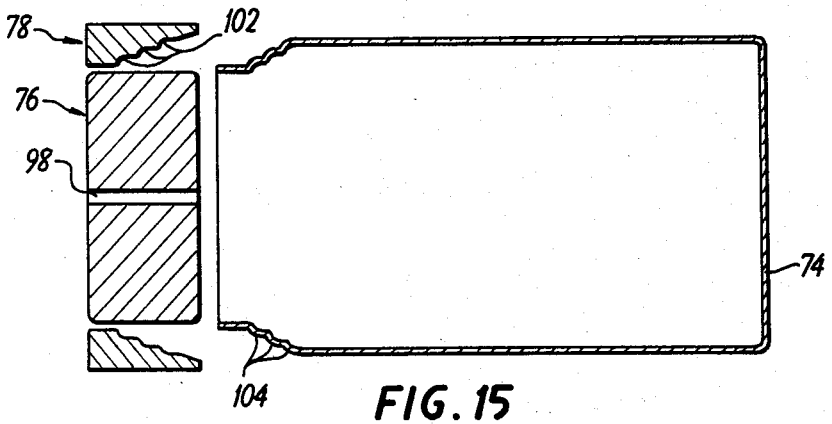
Figure 16:
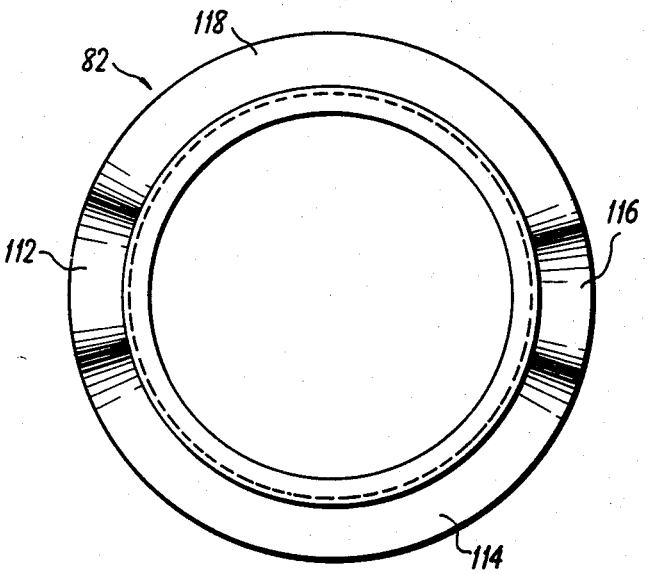
Figure 17:
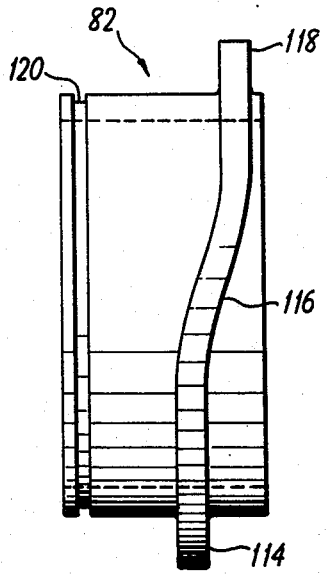
Figure 19:
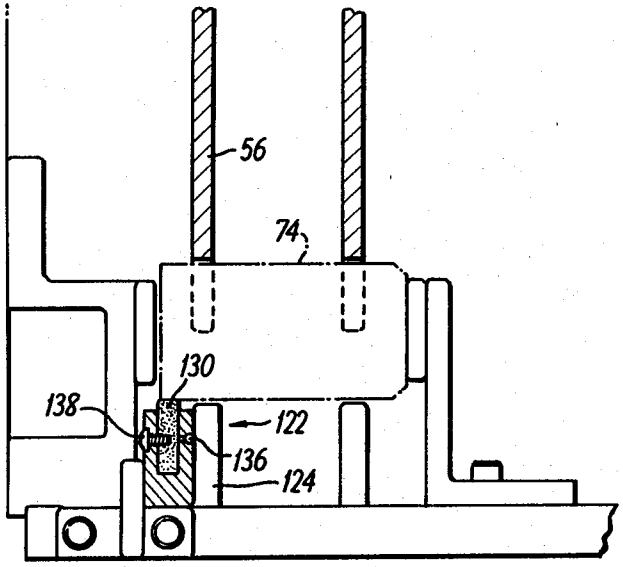
Figure 18:
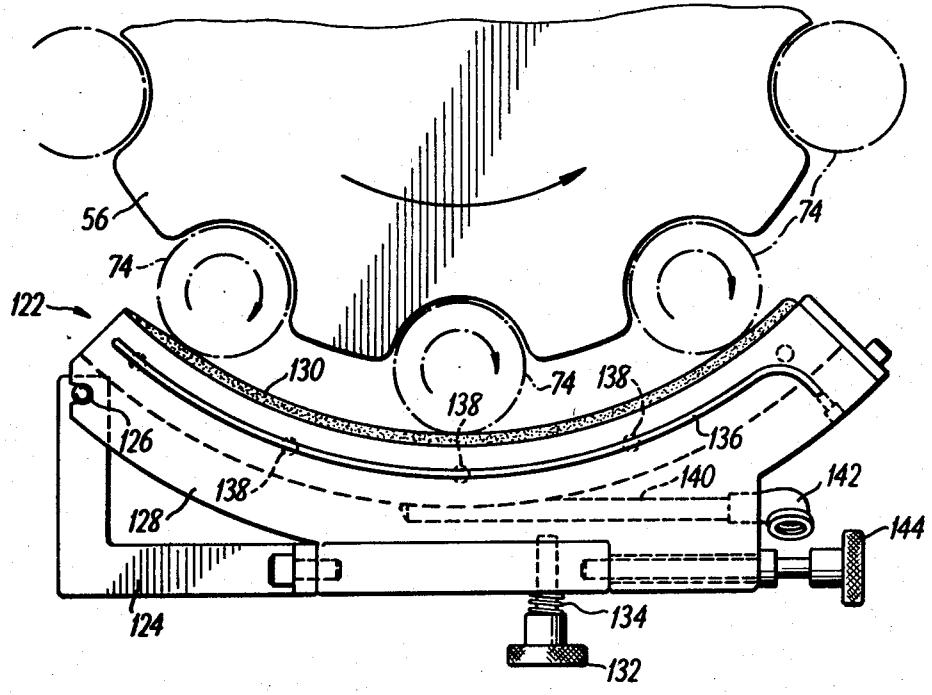

FIG. 11*a* is an elevational view in phantom of a modified pilot die especially useful for a stripping operation beginning in the FIG. 11 position;

FIG. 14 is an elevational view similar to FIG. 13 but illustrating the forming dies for making two successive necked-in portions;

FIG. 15 is an elevational view similar to FIG. 13 but illustrating the forming dies for making three successive necked-in portions;

FIG. 16 is a front elevational view of a typical cam used to control the forming dies;

FIG. 17 is a side elevational view of the cam of FIG. 16;

FIG. 18 is a fragmentary, front elevational view of a relubricating device; and FIG. 19 is a side elevational view of the relubricating device of FIG. 18.

Figure 1:
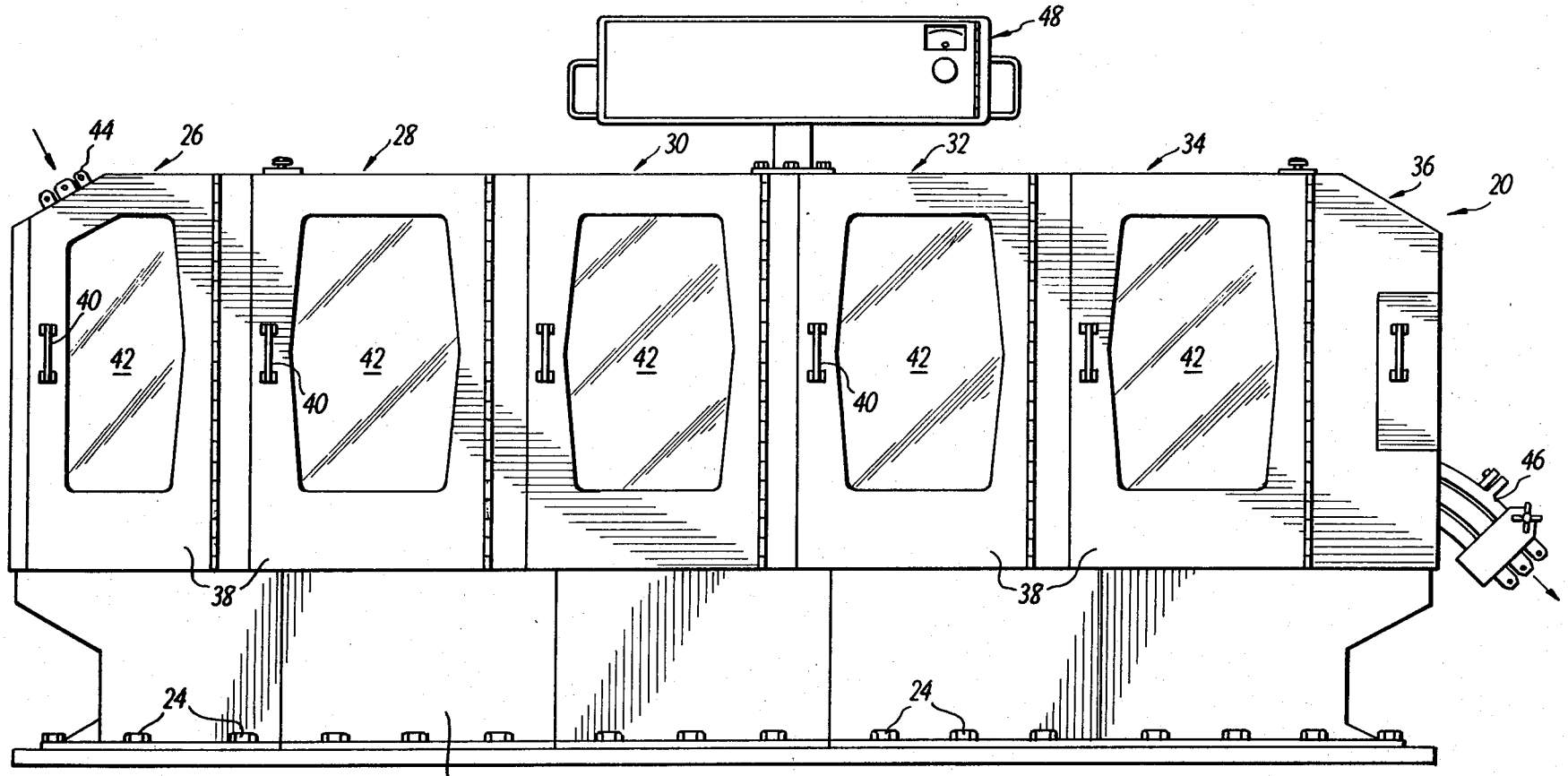
FIG. 1 is a front elevational view of the necking-in and flanging apparatus of the present invention with a built up frame assembly having three necking-in stations and one roll flanging station.

Referring now to FIG. 1 of the drawings there is illustrated a can necking-in apparatus indicated generally at 20 supported on a base or ground engaging structure 22 with suitable vibration absorbing supports or pads 23 at the bottom thereof. A feature of the invention is to bolt each section of the apparatus to the floor as a separate unit whereby one, two or three necked-in portions may be formed on a container. Thus, a plurality of stations are indicated generally by the numerals 26 for an infeed station, a first necking-in station 28, a second necking-in station 30, a third necking-in station 32, a spin flanging station 34, and an outfeed station 36. Stations 30 and 32 are optional and, if neither of them were used, spin flanging section 34 would abut the first necking-in station 28. The finished necking-in apparatus 20 customarily is provided with doors 38 openable by handles 40 in the event of a malfunction of the apparatus and provided with transparent windows 42 to observe the operation and any malfunction that may occur.

In conventional manner insofar as the present invention is concerned, containers are fed into the apparatus by a can end feed conveyor 44 and removed at a can outfeed station 36 by an outfeed conveyor 46. The apparatus may also be provided with a suitable control panel 48 which is also conventional as far as this invention is concerned.

Figure 2:
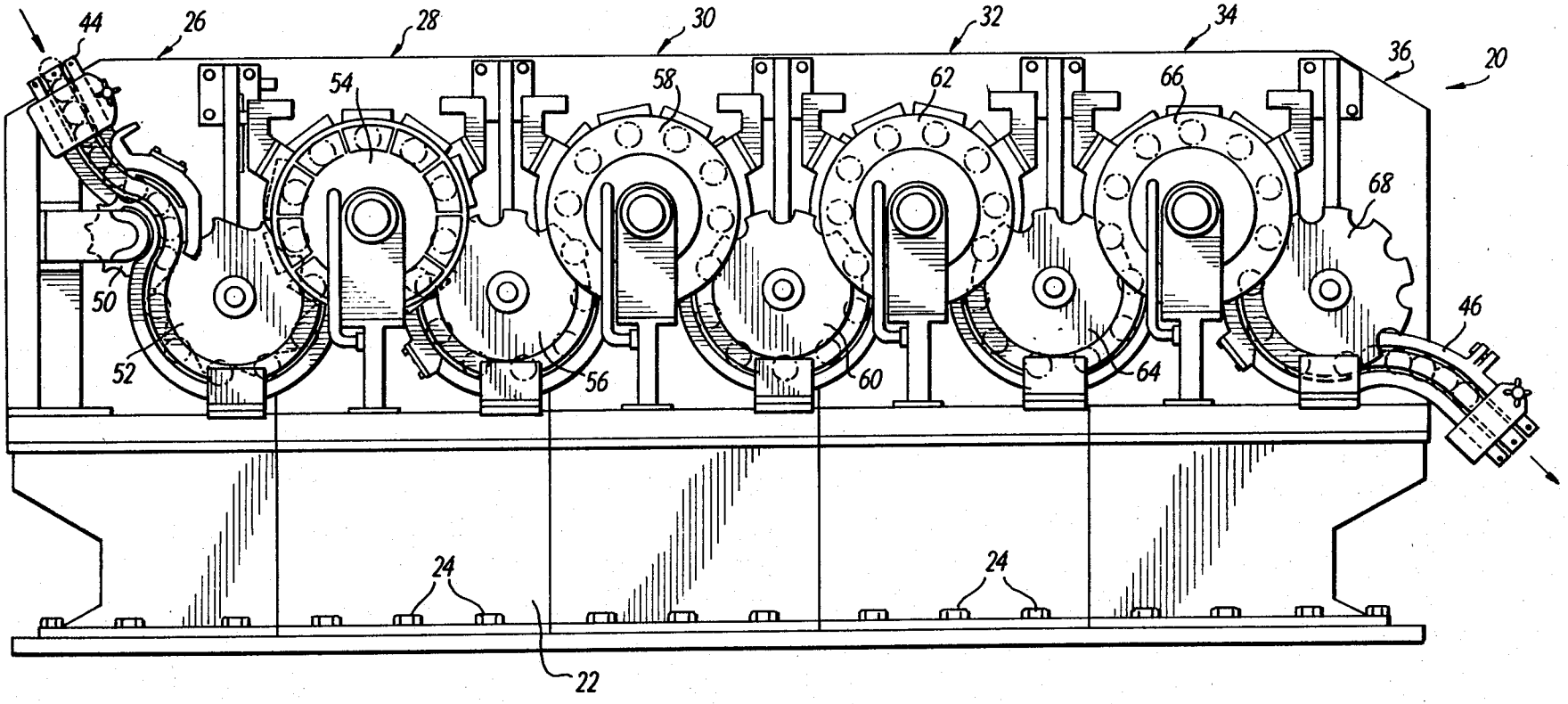
FIG. 2 is a front elevational view similar to FIG. 1 with portions removed.

Referring now to FIG. 2 the essential operational portion of FIG. 1 is illustrated with the doors removed to further illustrate a random pickup mechanism 50 at the infeed station 26. This random pickup mechanism receives the cans as delivered by the infeed conveyor 44 and transfers them to an infeed star wheel 52 which in turn transfers the cans to a first necking-in turret 54. After the first necking-in operation is performed in a manner to be described hereinafter, the cans are transferred to a transfer star wheel 56 and thence to the next station which will either be a spin flanging station or a second necking-in turret 58 when at least two necking-in portions are to be provided for a container.

In similar fashion after the second necking-in operation has been completed, the cans are then transferred to a transfer star wheel 60 and thence to either the spin flanging turret or a third necking-in turret 62 if a third necked-in portion is to be provided. In the latter event, the cans are again necked-in and the cans then transferred to transfer star wheel 64 for presentation to the spin flanging turret 66. One end of the container is flanged in this station 34 so that it will receive a can end after which the can is transferred to transfer star wheel 68 and then to the outfeed conveyor 46 for further treatment of the container.

Figure 3:
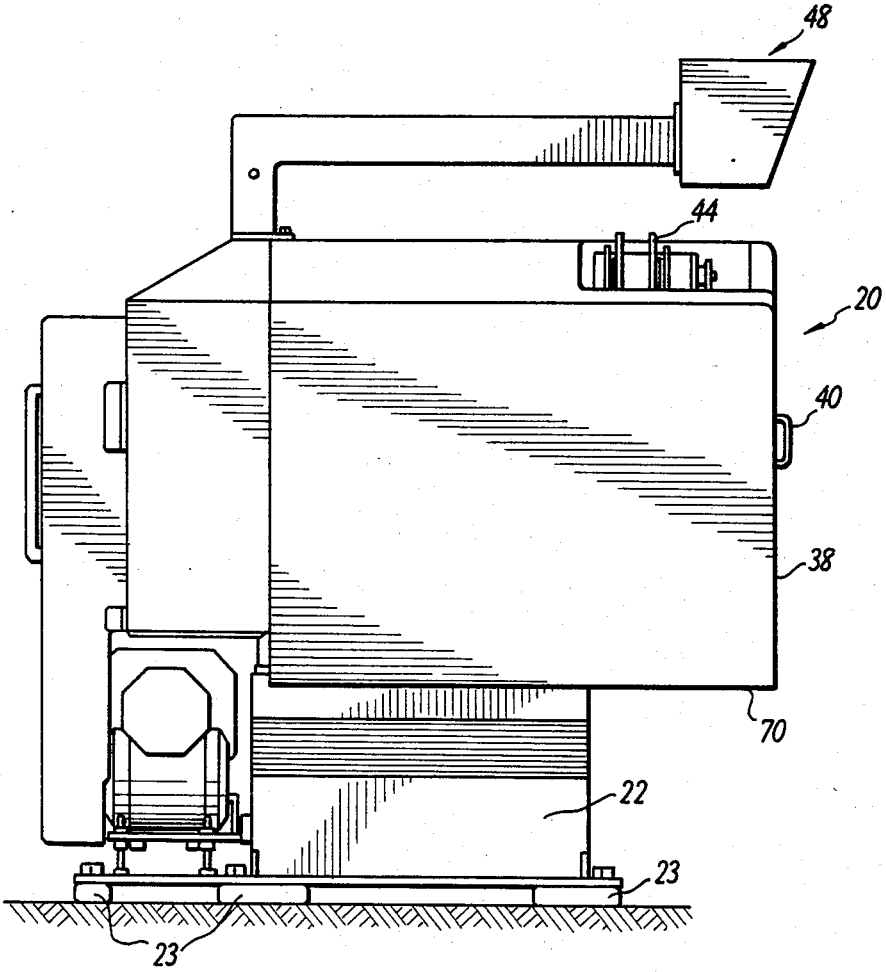
FIG. 3 is a left end elevational view of the apparatus of FIG. 1.

FIG. 3 illustrates another desirable feature of the invention, namely, to have the necking-in and flanging operations performed closely adjacent an accessible side of the machine so that in the event of a jam or malfunction, the malformed or jammed containers may be easily removed to permit continued operation. In this instance the cans pass closely adjacent to the front of the apparatus. Thus, FIG. 3 illustrates a cantilevered portion 70 of the apparatus and the positioning of the end feed mechanism closely adjacent doors 38 whereby access to a malfunction is most convenient.

Figure 4:
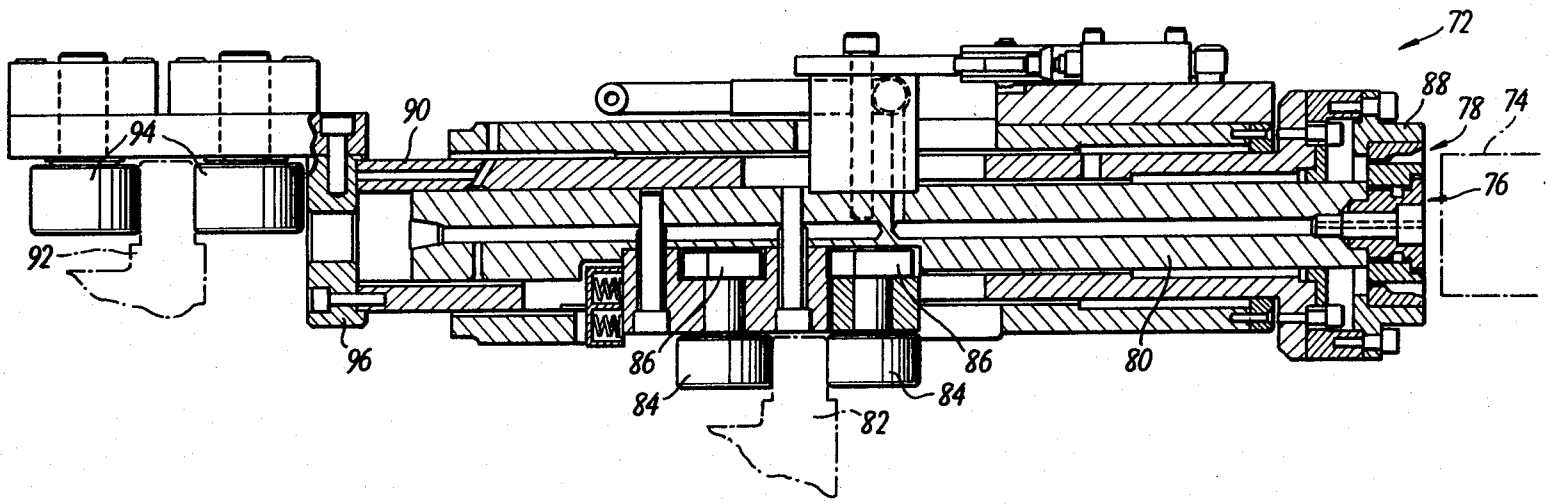
FIG. 4 is a fragmentary side elevational view taken in vertical cross section illustrating the necking-in apparatus used in the practice of the present invention.
Figure 5:
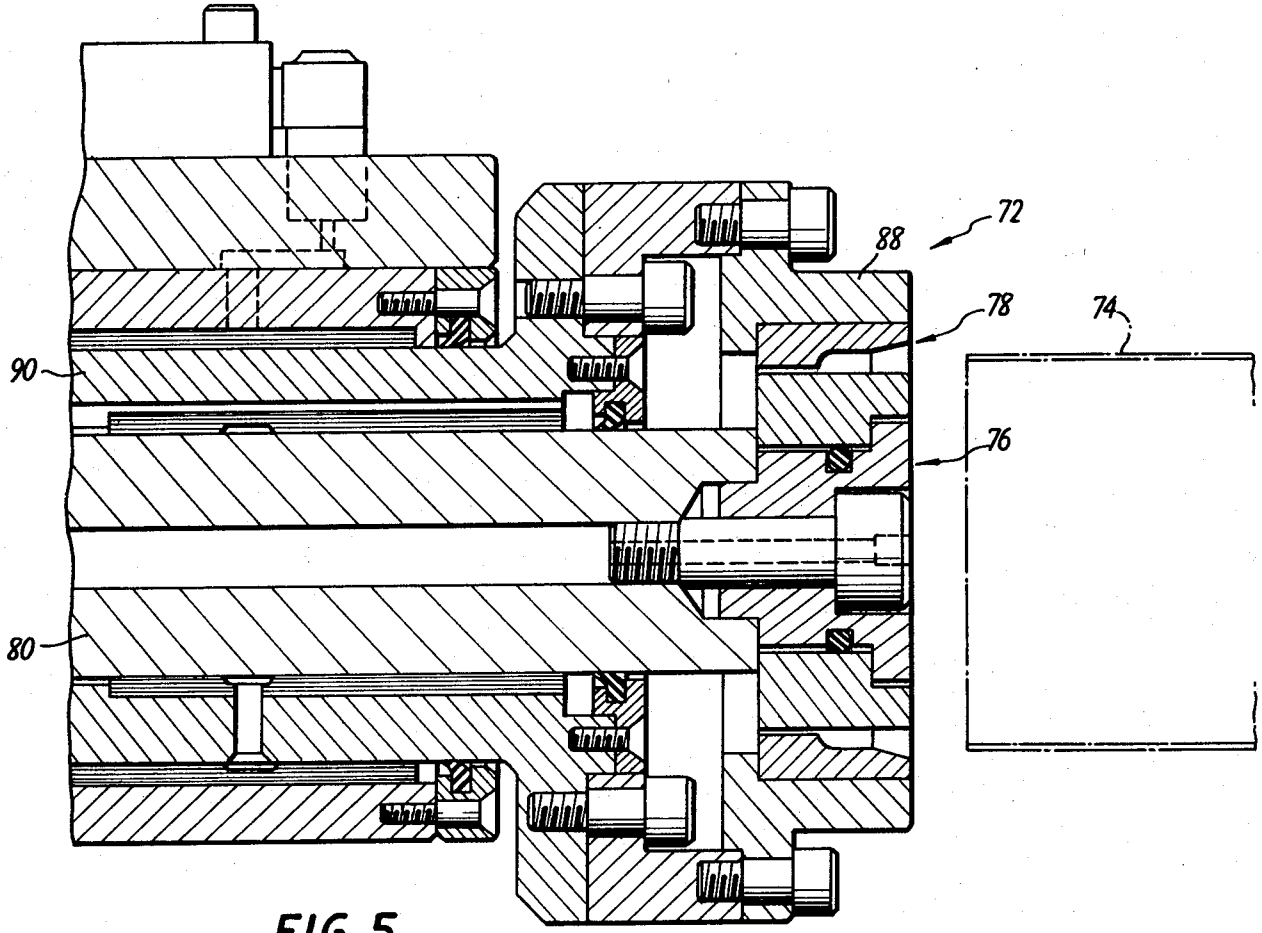
FIG. 5 is an enlarged fragmentary side elevational view taken in vertical cross section illustrating the right end portion of the apparatus of FIG. 4.
Figure 6:
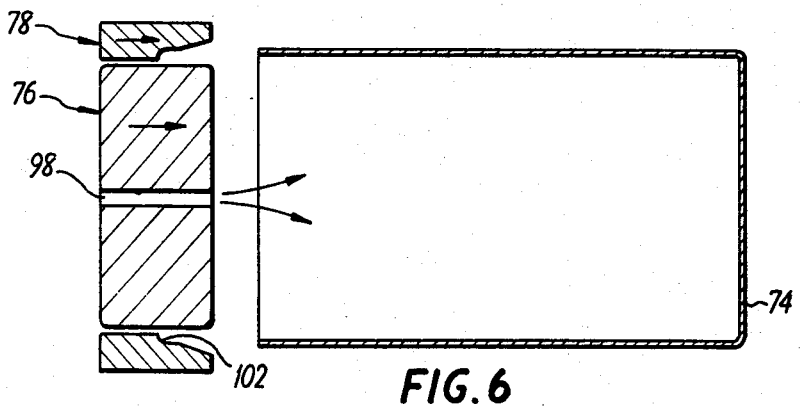
FIGS. 6–13 are elevational views which illustrate schematically in vertical cross section successive positions of a pilot die and a ring necking die in effecting necking-in of a can body in accordance with the present invention.
Figure 7:
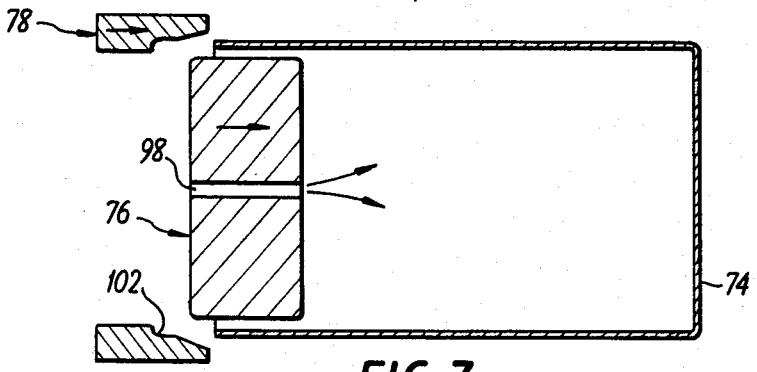

Reference is now made to FIGS. 4 and 5 which illustrate in greater detail the actual mechanism for necking-in the containers or cylindrical objects of the present invention. In these figures, a necking-in spindle is indicated generally at 72 for the double acting die forming mechanism, one of which is located at each indexed position of the rotary turrets in the necking-in stations 28, 30 and 32. A similar arrangement is provided for the spin flanging spindles positioned at each indexed position of the spin flanging turret 66 at station 34. Only the necking-in spindles are illustrated since the spin flanging of spindles may be conventional insofar as this invention is concerned.

A can body is shown in phantom at 74 immediately adjacent the necking-in spindle 72. A centrally located pilot die is indicated generally at 76 and a ring necking die is indicated generally at 78. The pilot die 76 is mounted on and moves under the influence of a central slide member 80 which is actuated by a pilot die cam 82 indicated in phantom in FIG. 4. Also in that figure, cam followers 84 are provided with abutment members 86 on a common shaft which engage the central slide member 80 and impart reciprocating motion thereto in accordance with the contour of cam 82. Cam 82 is rotary and will be discussed more fully in connection with FIGS. 16 and 17. The ring necking die 78 is held by a ring die holder member 88 which in turn is bolted to an external slide member 90 which is concentrically mounted with respect to the central slide member 80. The external slide member 90 is also reciprocated in accordance with the contour of a rotary ring die cam 92 which is also shown in phantom in FIG. 4. The rotary ring die cam 92 has cam follower members 94 engageable with a yoke member 96 at the rear of external slide member 90.

Reference is now made to FIGS. 6 through 13 for a description of the motions imparted to the centrally located pilot die 76 and the ring necking die 78. The FIGS. 6 through 13 show progressively indexed positions for the first necking-in turret mechanism 54 at station 28 of FIG. 2. In the FIG. 6 position can 74 is suitably positioned and held adjacent the necking in spindle and this may include vacuum means on the base of the container 74. In this position, compressed air is introduced through aperture 98 of pilot die 76 as indicated by arrows, and both the pilot die 76 and necking-in die 78 start to advance toward the open end of container 74. The relative advancement of the pilot die 76 is greater than that of the necking-in die so that by the indexed position illustrated in FIG. 7 the pilot die has been inserted into the open end of the container while both dies continue to advance.

Figure 8:
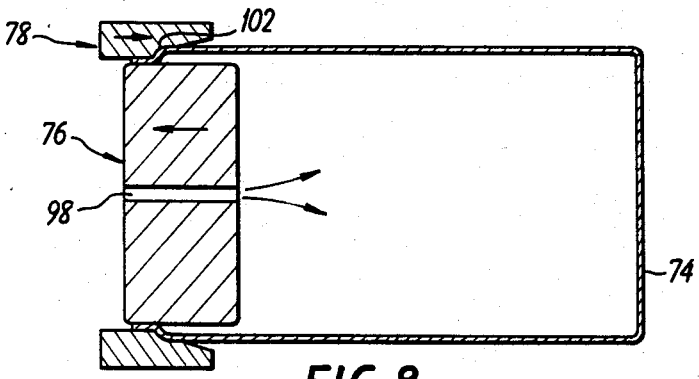

In the FIG. 8 position, the external can engaging necking-in portion 102 on the ring necking die has actually started the necking-in operation and the pilot die has begun moving in a reverse direction concurrently with the movement downwardly of the necking-in die 78. Thus, the pilot die is redirecting the tip or edge of can 74 as the necking-in operation proceeds.

Figure 9:
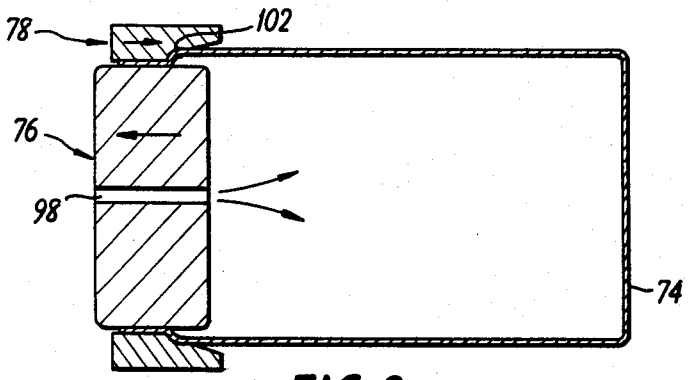

The aforementioned motion continues through the position illustrated in FIG. 9 as the ring necking die's inward movement is sustained so as to neck-in the upper marginal edge of the container while the pilot die continues its outward movement thereby pulling metal to simulate a pull or draw necking operation. In other words, the pilot die 76 helps to pull the metal of the container 74 around the curved formation 102 of the necking die as it necks inwardly the portion 104.

Figure 10:
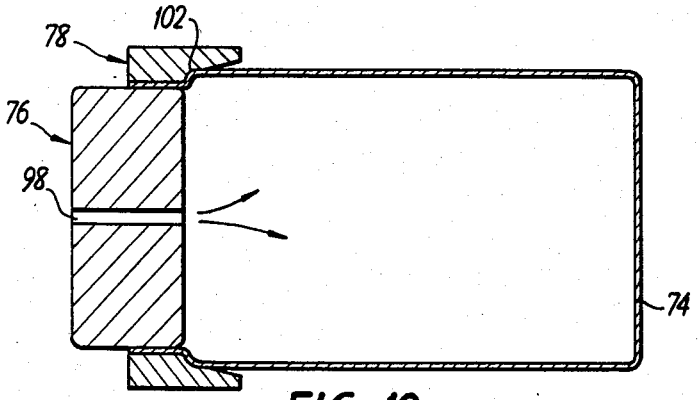

In the FIG. 10 position, both the ring necking-in die 78 and the pilot die 76 have come to a stop at the end of the necking operation. Preferably there is a stoppage of movement of the ring necking die 78 slightly before the stoppage of movement of pilot die 76.

In the FIG. 11 position, both the ring necking die 78 and pilot die 76 reverse their direction of movements so that the ring necking die 78 is moving outwardly while the pilot die 76 is moving back into the container to help strip the can from the ring necking die.

Figure 12:
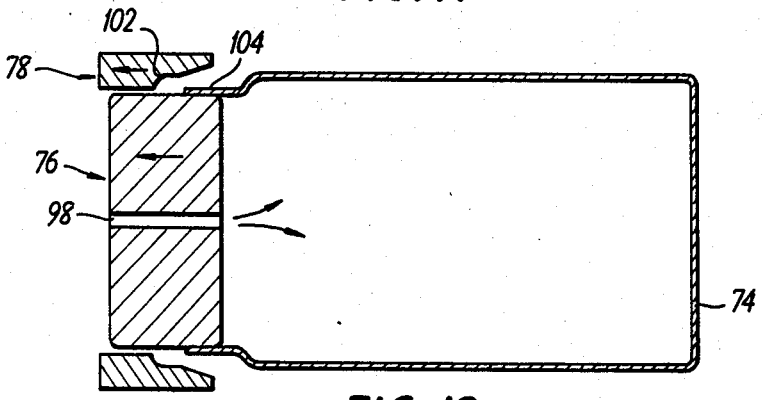

In the FIG. 12 position, the container 74 has been completely stripped from the ring necking-in die 78 and the pilot die 76 is now pulled out from the container using the compressed air through aperture 98 as an aid in this removal operation. In the position shown in FIG. 13, both dies are now back at their starting position and the can has been necked in at 104 and is ready to be processed further.

The aforementioned process eliminates wrinkled necks and permits the can end to be necked-in with the same thickness in the neck as in the lower portion of the bodywall. It also allows the use of necking radii which are larger than normal to give a stronger neck. It allows a necking-in operation of an approximately 10° die angle which combines with the same metal thickness in the body and neck to give greater columnar strength. Because of the latter, a thinner wall capacity is possible in this operation.

FIG. 11*a* illustrates a modification of the structure of the external wall of the pilot die 76. Thus, there is illustrated a slight overhang or shoulder 100 to provide an abutment engageable with the upper end of the container 104 when in the FIG. 11 position to further aid the stripping the container 74 from the ring necking die 78.

When a second necked-in portion at 104 is desired on a container 74, the ring necking die 78 is provided with a pair of can engaging necking-in portions 102 as is illustrated in FIG. 14. The centrally located pilot die 76 is provided with a slightly smaller diameter to compensate for the twin can engaging necking-in portions 102.

Similarly, when it is desired to provide three necked-in portions, the ring necking die 78 is provided with three can engaging necking-in portions 102 such as is illustrated in FIG. 15 in order to produce three necked-in portions 104 on the can body 74 as is illustrated in FIG. 15. Again the diameter of the centrally located pilot die 76 is made to correspond with the inner diameter of the ring necking die 78. In each instance the twice necked-in container or the thrice necked-in container goes through the steps as illustrated sequentially in FIGS. 6 through 13 as described previously. In this manner, it is possible to produce finished containers with smaller diameter container ends and since the can end is made thicker than the body wall of the container, it results in substantial monetary savings. For example, it is possible to go from an end size of 0.211 inches to 0.209 inches and to 0.2075 inches, as desired, with sequential necking-in operations.

The rotary cam itself is illustrated in FIGS. 16 and 17 as indicated generally by the numeral 82. Both cam 82 and cam 92 may take the form as illustrated in these figures. Thus, there is illustrated a rise portion 112 on the cam, a rear dwell portion 114, a fall 116, and a forward dwell, if any, 118. The cam may be secured in place by the use of a groove 120 shown in FIG. 17, so that the cam may be retained in position with suitable clamp clips.

Reference is now made to FIGS. 18 and 19 which illustrate a relubrication device between successive necking-in stations or between the necking-in station and the spin flanging station. the relubrication device is indicated generally at 122 and is shown to comprise an L-shaped bracket 124 which has a pivotal mounting 126 for an applicator support 128. An applicator in the form of a felt runner 130 is received within applicator support 128 which transmits lubrication in the form of oil or the like to its surface by capillary action.

A lubricator adjustment 132 is spring-loaded by means of spring 134 in order to bias or move the applicator support and thereby applicator 130 into the path of cans 74. The cans roll in a clockwise direction in FIG. 18 upon contact with the felt runner 130 when the transfer star wheel rotates in a counter-clockwise direction. The felt runner 130 is made sufficiently long to effect rotation of the can for a linear distance greater than its circumference so that the entire external cylindrical surface in the necked-in area of the can is relubricated. Oil or other lubrication is provided through a supply line 136 and the felt runner or felt wick is retained by retaining screws 138 shown more clearly in FIG. 19. An excess lubrication drain line 140 is shown in FIG. 18 with an elbow 142 at the end thereof. The elbow may be adjusted in position so as to control the amount of lubrication returned. A lubricator remover screw 140 permits the re-lubricating device 122 to be quickly mounted and dismounted from the apparatus.

Previous to this invention, it was virtually impossible to have a necked-in thickness less than about 0.007 inches, but in accordance with the present invention, the body wall may approximate a substantially constant 0.005 inches. The invention permits necking-in of the container wall by a simulated draw necking operation which eliminates wrinkled necks.

While the invention has been illustrated and described with respect to preferred embodiments thereof, it will be recognized that the invention may be otherwise variously embodied and practiced within the scope of the claims which follow.

That which is claimed is:

1. A method of effecting relubrication of a necked-in portion of a can body immediately following the necking in operation which comprises the steps of a. supporting said can bodies in spaced, semicircular pockets of a rotary star wheel with the longitudinal axis of each can body being in a horizontal plane, b. positioning an arcuate runner member containing a lubricating fluid sufficiently close to said rotary star wheel to engage a necked-in portion of each container in said pockets and effect rotation of the containers within the pockets, (1) said arcuate runner member being sufficiently long to engage a plurality of containers simultaneously and also long enough to effect lubrication of the entire circumference of each container held within said pockets, c. and delivering said can bodies to another star wheel for a second necking-in of said can bodies.

2. A method of effecting relubrication of a necked-in portion of a can body as defined in claim 1 including the additional step of making said oil containing member from a material which permits capillary action.

3. An apparatus for effecting relubrication of a necked-in portion of a can body which comprises a. a rotary star wheel having semicircular pockets for supporting can bodies therein, b. bracket means for holding a lubrication applicator, c. a lubrication applicator received within said bracket means, (1) said lubrication applicator having an arcuate exterior surface conforming to the outermost tangential position of said necked-in portions of can bodies received within the pockets of said rotary star wheel, (2) said lubrication applicator being made of a material which permits capillary action and containing lubrication means for said necked-in portion of said can bodies, (3) said lubrication applicator being sufficiently long to engage a plurality of can bodies simultaneously, and (4) said lubrication applicator effecting rotation of said can bodies while the longitudinal axis of said can bodies is disposed horizontally within the pockets of said rotary star wheel by frictional engagement therewith, with said rotation of each can body being greater than the circumference of the can body before said can body leaves the engagement with said lubrication applicator.

4. An apparatus as defined in claim 3 wherein said lubrication applicator is made from felt material.

5. A method of effecting relubrication of a necked-in portion of a can body as defined in claim 2 including the additional step of making said oil containing member from felt.

* * * * *